US006523788B2

(12) United States Patent
Zander

(10) Patent No.: US 6,523,788 B2
(45) Date of Patent: Feb. 25, 2003

(54) MODEL RAILROAD CROSSING GATE

(76) Inventor: Dennis R. Zander, 35 Rolling Meadows, Penfield, NY (US) 14526

( * ) Notice: Subject to any disclaimer, the term of this patent is extended or adjusted under 35 U.S.C. 154(b) by 0 days.

(21) Appl. No.: 09/829,232

(22) Filed: Apr. 9, 2001

(65) Prior Publication Data

US 2002/0145083 A1 Oct. 10, 2002

(51) Int. Cl.[7] ..... B61L 23/00; E05F 1/10
(52) U.S. Cl. ..... 246/111; 104/DIG. 1; 49/386
(58) Field of Search ..... 246/111, 112, 246/113, 125, 126, 127; 104/DIG. 1; 49/49, 386, 387

(56) References Cited

U.S. PATENT DOCUMENTS 1,806,497 A * 5/1931 Polack ..... 246/111
4,369,943 A * 1/1983 Hussein ..... 246/127

* cited by examiner

*Primary Examiner*—S. Joseph Morano
*Assistant Examiner*—Robert J. McCarry, Jr.

(74) *Attorney, Agent, or Firm*—Stephen B. Salai, Esq.; Roger Aceto, Esq.; Harter, Secrest & Emery LLP

(57) ABSTRACT

A model railroad crossing gate includes a base, a crossing gate mounted on the base for movement between a raised position and a lowered position, a spring coupled to the crossing gate biasing the gate to the raised position, a string attached to the crossing gate and the base for pulling the gate against the spring, and a tensioner engaging the string for pulling the gate from the raised position to the lowered position. A controller is coupled to the tensioner for controlling the position of the gate. The controller is preferably is also coupled to a limit sensor and a motor for operating the motor to move the gate from the raised position to the lowered position or vice versa and then stop the motor. The controller includes a first input responsive to an input pulse for producing a crossing gate activating signal having a duration longer than the duration of the input pulse for moving the crossing gate fully between its raised and lowered position, and a second input responsive to an input signal longer than a predetermined minimum for producing a crossing gate activating signal having a duration equal the duration of the input signal. The controller includes an output for controlling a second controller and an input for receiving signals from a remote controller.

24 Claims, 8 Drawing Sheets

MODEL RAILROAD CROSSING GATE

This invention relates generally to accessories for toy or model railroad layouts and more particularly to a crossing gate for a model railroad layout that simulates a crossing gate for a full-size railroad.

Grade level crossings of railroad lines in both full-size and model railroad layouts are normally controlled by signals and/or crossing gates that warn motorists of the approach of a train and prevent all but the truly reckless from entering the grade level crossing ahead of a train which can lead to serious accidents.

Crossing gates on a full-size railroads are controlled by a complex control system that causes the gates to be lowered to prevent access to the crossing shortly before a train arrives and to be raised to allow access to resume after the train has departed. Crossing gates for model railroads typically have somewhat simpler control systems but nevertheless require the detection of approaching trains or the manual actuation of the crossing gates by an operator to simulate the operation of full-size crossing gates.

Herefore, a number of techniques has been used to detect the presence of a train. Quite commonly, an isolated rail section is provided that is shunted electrically by the passage of a train thereover thereby allowing the presence of a train to be detected. More recently, magnetic or light actuated proximity sensors have been employed to detect the passage of trains. These detectors provide some advantages over isolated rail detectors in that they can be added to existing layouts without replacing rail segments. However, they must be wired to the devices they control be they crossing gates, signals, switches or the light. While the complexity of such wiring is interesting for some, it creates obstacles to the enjoyment of the model railroading experience for others and there is a continuing need for simpler devices that retain the realism of their more complex predecessors.

It is conventional for crossing gates to guard grade level crossings from each of two possible access directions. While in actual railroads the gates may be controlled independently it is desirable in model railroad layouts to provide common control to reduce cost and complexity. Herefore, train detectors separate from the crossing gates have been employed to lower the gates in advance of an approaching train. There is a need for a simpler arrangement and it is an object of this invention to address this and other needs.

When a train approaches a crossing, a signal located remotely from the crossing can lower the gates in advance of the train. However, the gates need to remain lowered until the train has passed the crossing and the advance signal can not provide this function. Therefore, there is a need for a train sensor at the gate location to keep the gate closed while the train is passing and open it after the train has left the crossing.

In previous crossing gate designs for model trains, the mechanism to raise and lower the gate or arm has required significant space and energy. This meant that the mechanism did not appear scale size or did not operate in a realistic manner. The solenoid driven crossing gates had a very fast banging action and the solenoid had to be energized for the entire time the gate was down. Other designs with larger mechanisms required that the mechanism be under the train table, which required connecting linkages to be aligned and also required under table wiring. It is an object of this invention to overcome these shortcomings.

It is another object of this invention to provide a combination crossing gate and train detector that eliminates the need for separate train detectors to operate the crossing gate.

It is another object of this invention to provide a simple but reliable mechanical construction for a crossing gate that simulates the action of a full-size crossing gates more accurately than has been possible with some of the other mechanical constructions for model railroad crossing gates known previously.

It is another object of this invention to provide a crossing gate construction that tolerates manual operation of the crossing gate and specifically, that allows the crossing gate to be manually depressed without breaking anything.

It is another object of the crossing gate of this invention to provide a pair of crossing gate assemblies that can be arranged for guarding opposing accesses to a grade level crossing and which cooperate to provide train detection between them without the need for complex signaling wiring.

Briefly stated and in accordance with presently preferred embodiment of the invention, a model railroad crossing gate includes a base, a crossing gate mounted on the base for movement between a raised position and a lowered position, a spring coupled to the crossing gate biasing the gate to the raised position, a string attached to the crossing gate and the base for pulling the gate against the spring, and a tensioner engaging the string for pulling the gate from the raised position to the lowered position.

In accordance with another aspect of the invention, the string is led through an opening in the base and the tensioner is concealed in the base.

In accordance with another aspect of the invention, a motor is mounted in the base and coupled to the tensioner.

In accordance with another aspect of the invention, the crossing gate includes a limit sensor coupled to the tensioner for determining when the gate is fully raised or fully lowered.

In accordance with another aspect of the invention, the motor is coupled to the tensioner by a reducing gear train.

In accordance with another aspect of the invention, a controller is coupled to the tensioner for controlling the position of the gate. The controller is preferably is also coupled to the limit sensor and the motor for operating the motor to move the gate from the raised position to the lowered position or vice versa and then stop the motor.

In accordance with a preferred embodiment of the invention, the tensioner comprises a rotatable cam coupled to the string for tensioning the string as the cam is rotated.

In accordance with another aspect of the invention, the controller is responsive to an input pulse or a longer signal for moving the gate between a raised position and a lowered position.

In accordance with another aspect of the invention, a controller for a model railroad crossing gate includes a first input responsive to an input pulse for producing a crossing gate activating signal having a duration longer than the duration of the input pulse for moving the crossing gate fully between its raised and lowered position, and a second input responsive to an input signal longer than a predetermined minimum for producing a crossing gate activating signal having a duration equal the duration of the input signal.

In accordance with another aspect of the invention, the controller for a model railroad crossing gate includes an output for controlling a second controller and an input for receiving signals from a remote controller.

In accordance with another aspect of the invention, the controller includes a motor controller responsive to a crossing gate activating signal for activating a motor for controlling the position of a crossing gate.

In accordance with another aspect of the invention, a controller for a model railroad crossing gate includes a flashing controller responsive to a crossing gate activating signal for producing flashing light signals.

In accordance with another aspect of the invention, the controller includes a bell sound generator responsive to a crossing gate activating signal for producing a bell sound.

In accordance with another aspect of the invention, a model railroad crossing gate construction for guarding two accesses to a simulated grade level crossing includes a first crossing gate having a light source and a second crossing gate having a light detector. A controller in the second crossing gate maintains the crossing gate in an up position in response to a continued detection of a signal from the light source and moves the crossing gate to a lowered position if the light from the light source is interrupted by the passage of a train between the light source and the light detector. The crossing gates preferably include an electrical connection between the first and second crossing gates for synchronizing the operation of the first crossing gate having the light source with the second crossing gate having the light detector. Preferably, the light source and light detector are infrared light sources and light detectors. More preferably, the light source is a pulsed light source and the light source discriminates between pulsed light from the light and a steady ambient light.

The novel aspects of the invention are set forth with particularity in the appended claims. The invention itself together with further objects and advantages thereof may be more readily understood by reference to the following detailed description of a presently preferred embodiment of the invention taken in conjunction with the accompanying drawing in which:

Figure 1:
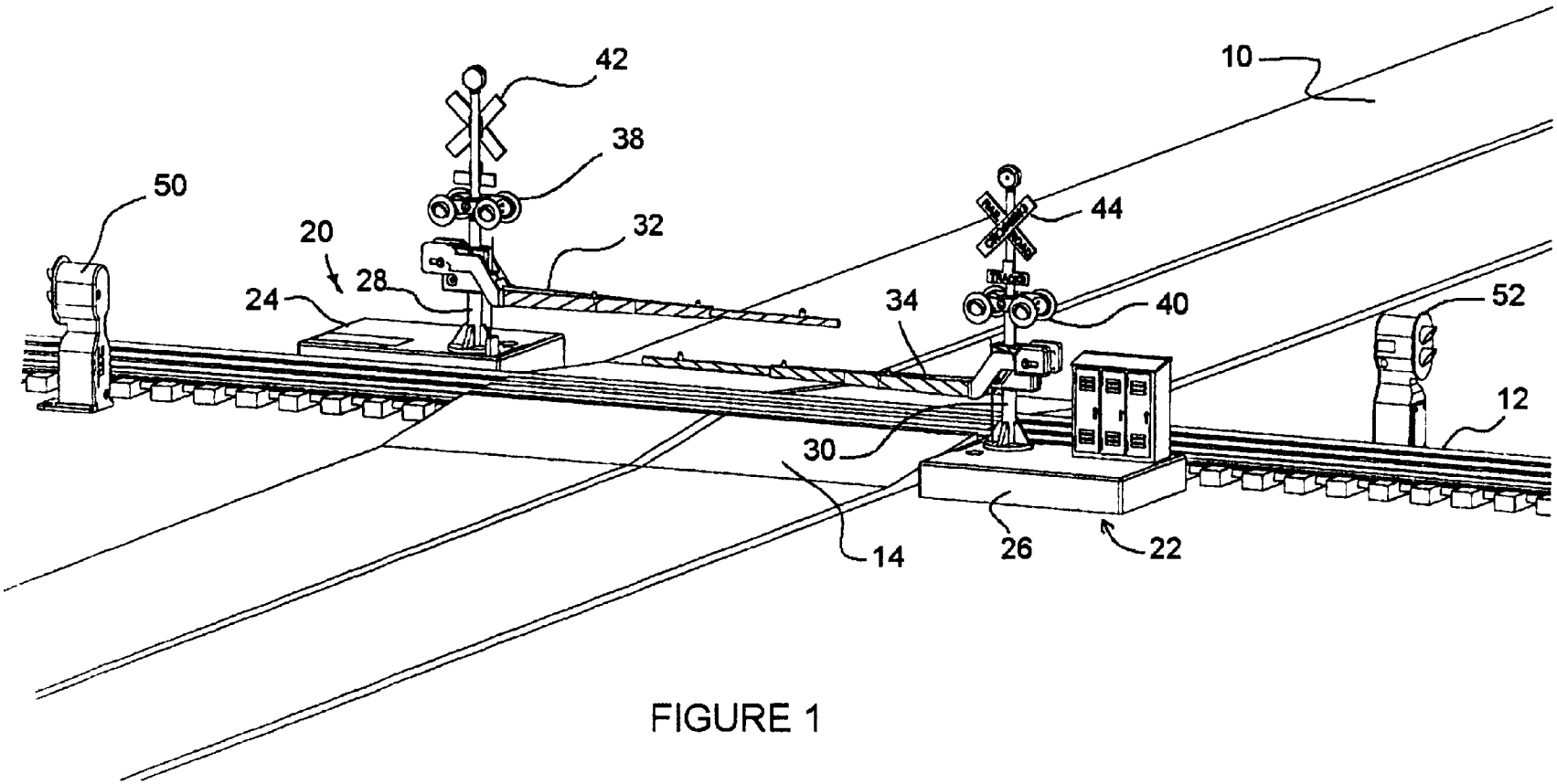
FIG. 1 is a diagrammatic view of a grade level model railroad crossing showing a pair of crossing gate assemblies in accordance with the invention and two block signals.

Referring now to FIG. 1, a model railroad grade level crossing is illustrated in diagrammatic form. A simulated roadway 10 crosses a single model railroad line 12 at a grade level crossing 14. While a single line is illustrated for purposes of describing the invention, it will be understood that the invention may also be used in connection with multiple line crossings. A first crossing gate assembly 20 in accordance with the invention is positioned at one side of the crossing and a second crossing gate assembly 22 is positioned at the other side. Each of the crossing gate assemblies includes a base 24, 26 on which a tower 28, 30 is mounted. A crossing gate arm 32, 34 is pivotably attached to each of the towers 28, 30 and positioned so that when in a lowered position is shown in FIG. 1, the gate arms 32, 34 guard access to the crossing 14. Preferably, to improve the realism of the crossing gates, signal lights 38, 40 and cross bucks 42, 44 are mounted on the tower above the gate arms.

Preferably, but not necessarily, one of more block signals 50, 52 which may also include detectors as described in my co-pending application U.S. Ser. No. 09/826,654, filed Apr. 5, 2001, are positioned along side of a right of way at a distance from the crossing. When the block signal detectors 50, 52 or another detector such as an isolated track segment detects the approach of a train, signals are sent to gate assemblies 20 and 22 to cause the gates 32, 34 to move to the lowered position shown in FIG. 1 to guard the crossing.

Figure 2:
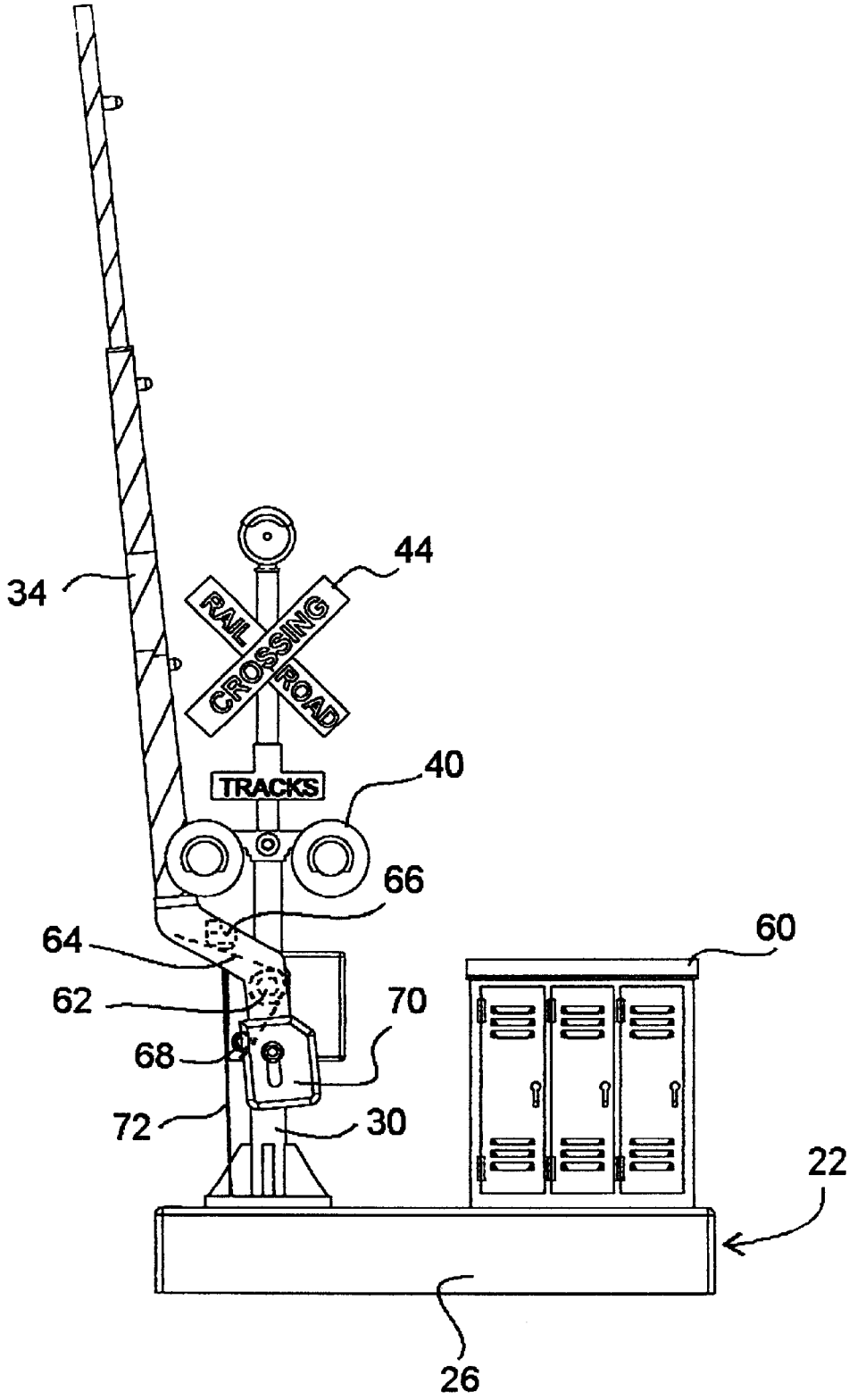
FIG. 2 is a front elevation of signal crossing gate in accordance with the invention.

Referring now to FIG. 2, gate assembly 22 is shown in more detail in a side elevation thereof. Base 26 is preferably formed from injection molded high impact plastic although other types of construction could also be used. Tower 30 is attached to base 26 by convention means such as fasteners or a snap fit arrangement or the like. A simulated equipment cabinet 60 is provided for housing a speaker or the like as will be described in more detail later.

Figure 3:
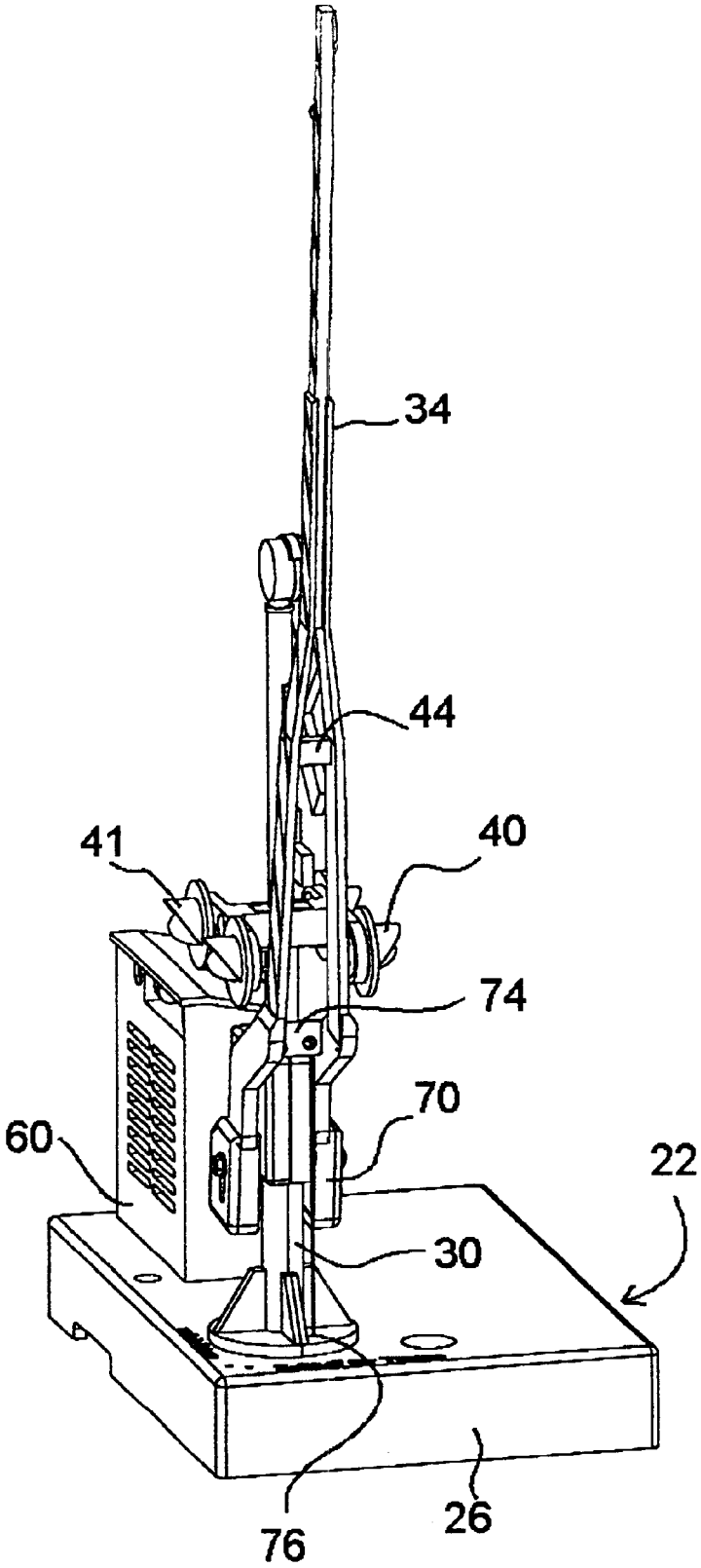
FIG. 3 is a perspective view of the crossing gate of FIG. 2 showing the gate in the raised position.
Figure 4:
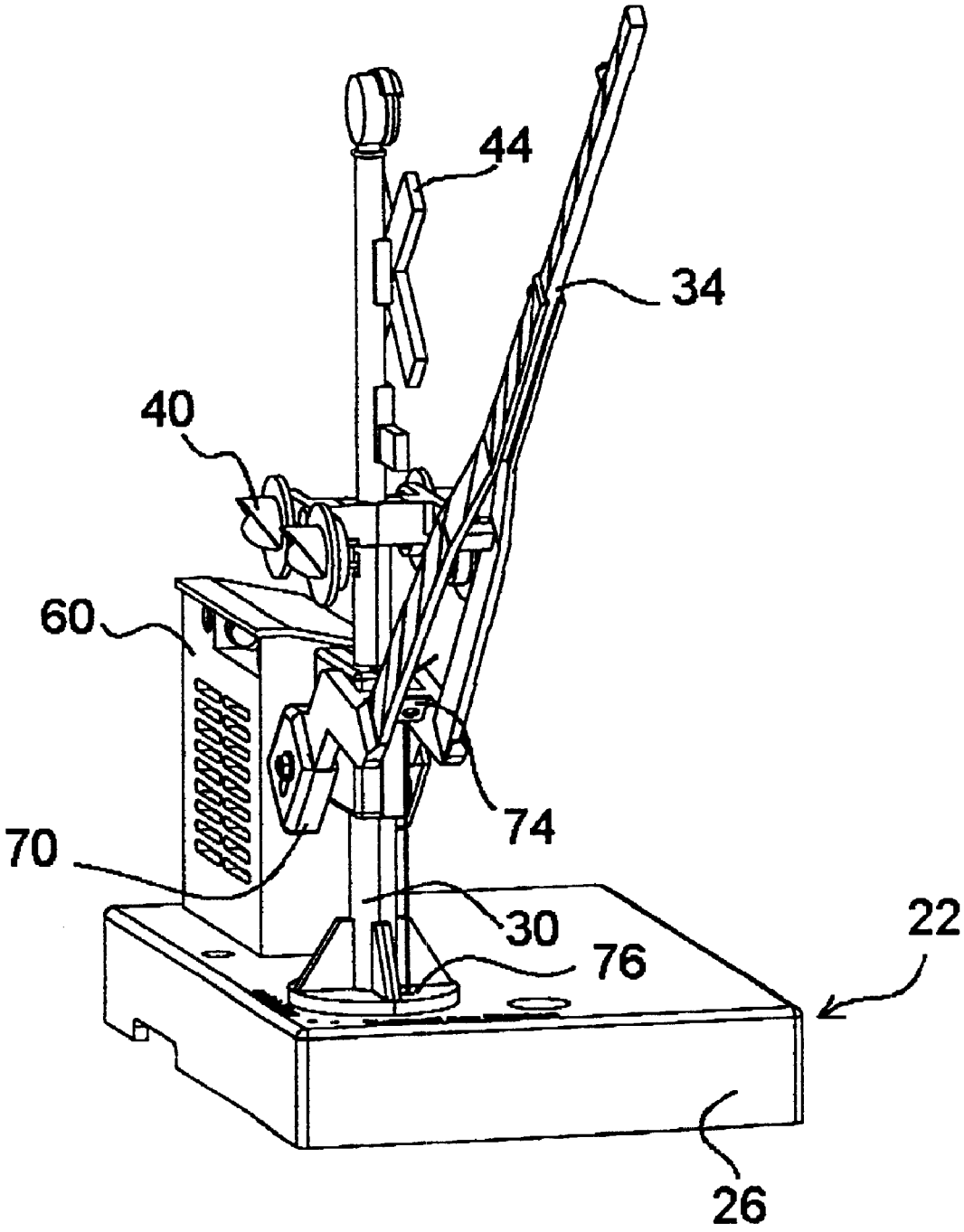
FIG. 4 is a perspective view of the crossing gate of Figure showing the gates in a partially lowered position.

A gate arm 34 is attached to tower 30 at a pivot point 62 that allows the arm to pivot with respect to the tower from the raised position shown in FIGS. 2 and 3 through an intermediate position shown in FIG. 4 to the lowered position shown in FIG. 1. A spring 64 is preferably wound around pivot 62 and engages a first boss 66 on the gate arm and a second boss 68 on the tower to bias the gate arm to a raised position as shown in FIG. 2. A simulated counter weight may be provided to make the gate more closely resemble a real gate but the counter weight 70 has a minimal efficacy in the model.

The gate arm 34, normally biased to a raised position by spring 64, is moved to a lowered position is shown in FIG. 1 by applying tension to a string 72 attached to the gate at a point spaced outwardly from pivot 62. Preferably, string 72 is made from a low stretch heat resistant material to ensure reliable long term operation of the gate. While a high tensile strength string or fishing line is preferred in accordance with this invention, other materials could also be used such as flexible wire or the like. Preferably, a narrow gauge filament is used so that the filament is as unobtrusive as possible since it does not correspond to the construction of a full size crossing gate.

Referring now to FIG. 3, the gate assembly is shown in a perspective view from a different side. In this and the other figures, like numbered elements are designated by like reference numerals. String 72 has been removed. The string passes through openings 74 and 76 in the gate arm and tower base respectively to a mechanism mounted in base 26 that will be described later.

The gate is shown again in FIG. 4, this time in a partly lowered position. The access holes 74 and 76 to the thread remain visible in this view.

Figure 5:
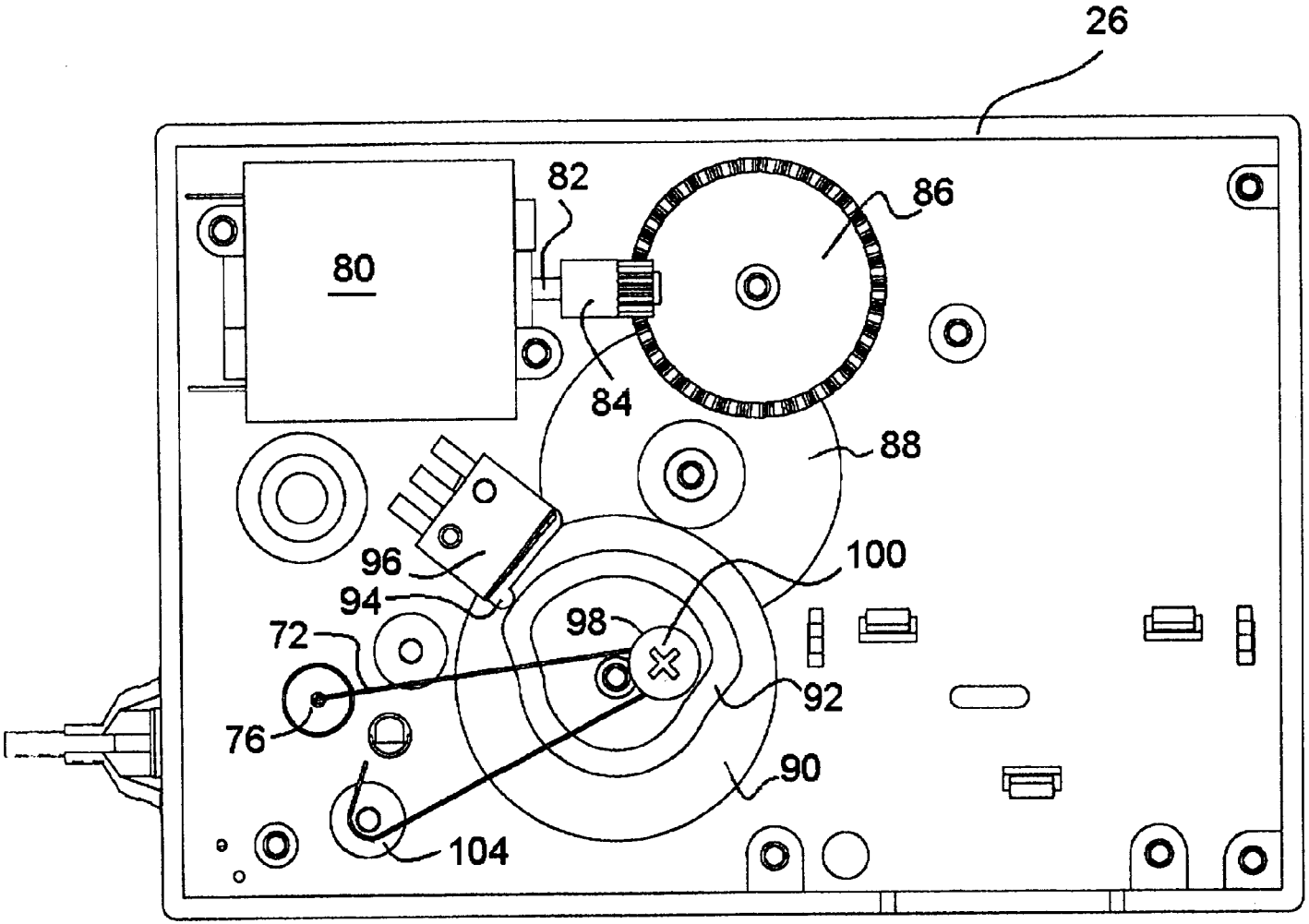
FIG. 5 is a diagrammatic view of the gate driving portion of the crossing gate of this invention.

Referring now to FIG. 5, a tensioning mechanism for tensioning the string to move the gate arm between the raised and lowered position is illustrated. All of the components of the tensioning mechanism are mounted within base 26. Motor 80 has an output shaft 82 on which a spur gear 84 is mounted. Motor 80 drives a gear train that includes spear gear 84 and reduction gears 86, 88 and 90 that together reduce the motor RPM to provide realistically slow operation of the gate arm.

Gear 90 also includes a position cam 92 that engages a movable arm 94 of a limit switch 96 on the operation of which will be described in more detail below. An eccentric post 98 (not visible) is positioned on gear 90 at an eccentric position, that is a position removed from the center of the gear. A fastener such as a screw 100 is provided in the end of post 98.

String 72 passes through hole 76 as already described and is trained around fastener 100 to a fixed post 104 to which it may be tied or otherwise secured to prevent slipping.

In operation, motor 80 drives the reducing gear train to turn gear 90 from the position shown in FIG. 5 where the gate is lowered to an opposite position with screw 100 positioned to removed tension from line 72 allowing the gate arm 32 to return to the up position as biased by spring 64. The mechanism just described provides a relatively slow realistic looking motion for the gate arm that is more realistic than the snap action solenoid motions provided for gate arms in the past. Limit cam 92 holds switch 96 closed in the position shown in FIG. 5 but will be understood to allow switch 96 to open when gear 90 is rotated to its opposite position. While the embodiment of the invention just described is presently preferred, it will appreciated that the string may be tensioned by other mechanical arrangements which are also intended to be covered. Where a slow motor is employed, the gear train may be dispensed with. The string could be wound on a spool attached to the motor or a spool attached to the gear 90.

Figure 6:
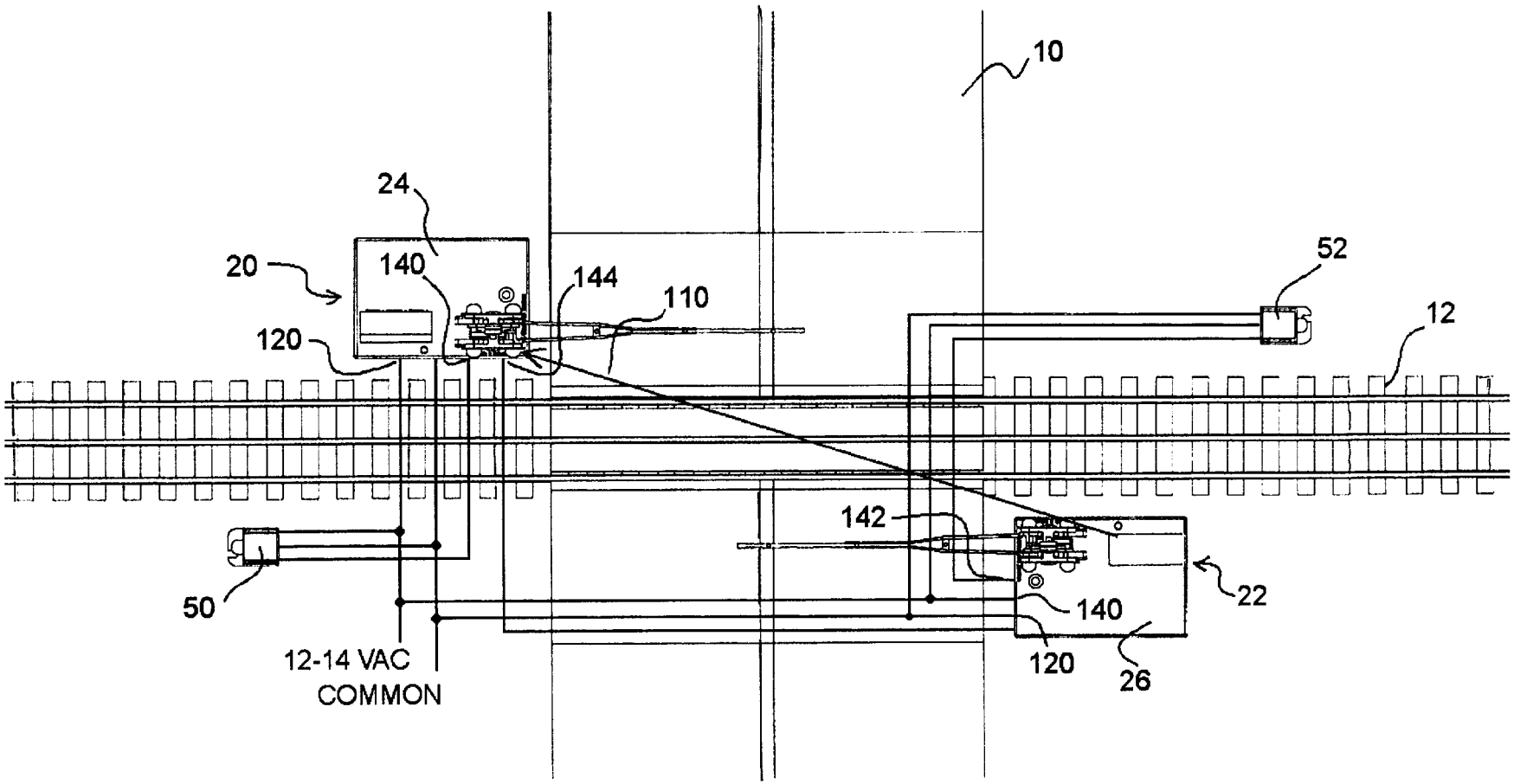
FIG. 6 is a top plan view of the grade level crossing of FIG. 1.

The controller for operating the crossing gate of this invention will now be described in connection with FIGS. 6–8. FIG. 6 is a top plan view of a grade level crossing showing roadway 10 and crossing gates 20 and 22 guarding track 12. An arrow 110 shows the path of a train detector beam as will be described in more detail below passing from gate assembly 22 to gate assembly 20.

Figure 7:
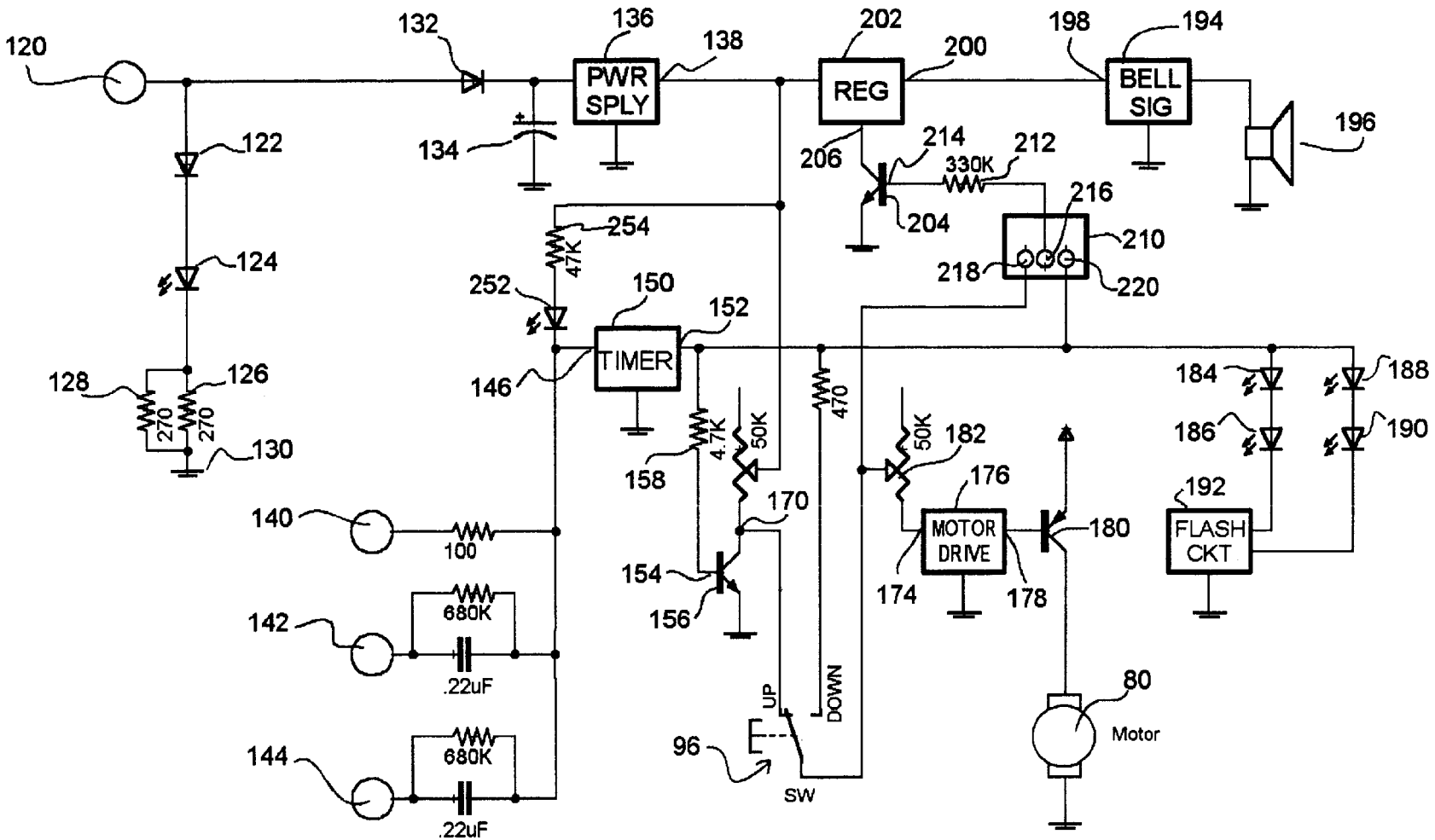
FIG. 7 is a part schematic part block diagram of one of the crossing gate of FIG. 1.

FIG. 7 is a part schematic part block diagram of the electrical circuit of the controller for operating closing gate 22. The controller is designed to be powered from a 12–14V AC source of the type used to power model trains and accessories. A power input terminal 120 is connected to a half wave rectifier diode 122 in series with a light emitting diode 124 and current limiting resistors 126 and 128. The series combination of rectifier diode 122, light emitting diode 124 preferably an infrared emitting diode and a current limiting resistors 126, 128 are connected to common 130, sometimes as referred to as ground herein for convenience.

Light emitting diode 124 is preferably an infrared emitting diode. The diode is preferably selected to be fast enough so that rectifier 122 provides a 60 Hz pulsating light output from diode 124 rather than a steady state output. This is useful in discriminating against ambient light in a detector as will be described shortly.

Power input 120 is also connected to rectifier diode 132 and filter compacitor 134 that provide DC input to a power supply regulator 136 which produces a DC power signal of approximately 8.6V at output 138 thereof. Power supply 136 also has a connection to ground.

The controller of FIG. 7 includes three signal inputs 140, 142 and 144. Input 140 is adapted to be connected to companion crossing gate 20 to synchronize operation of the crossing gates. Inputs 142 and 144 are pulse inputs adapted to be connected to remote train proximity sensors such as block signal detectors 50 and 52. Inputs 142 and 144 are responsive to pulse input signals applied to input 146 of timer 150.

Output 152 of timer 150 is connected to the base 154 of transistor 156 through a current limiting resistor 158. Collector 170 of transistor 156 is connected to limit switch 96 that in turn is connected to an input 174 of a motor drive circuit 176. Output 178 of motor drive 176 is connected to motor drive transistor 180 which is connected to motor 80.

Preferably, motor drive 176 is a pulse drive the pulse rate of which is controlled by variable resistor 182 connected to input 174.

Preferably, the controller also includes a flashing light function. Output 152 of timer 150 is connected to visual light emitting diodes 184, 186, 188 and 190 which are collectively designated as signal lights 40 in the previous figures. A signal light flashing circuit 192 is connected between the diodes and ground to cause the diodes to flash when they are energized by timer 150.

Preferably, the controller also includes a signal bell circuit. A bell signal synthesizer 194 is connected to a speaker 196 preferably mounted in simulated equipment cabinet 60 as already described. Bell signal synthesizer 194 has an input 198 connected to an output 200 of a controllable voltage regulator 202. The output voltage of regulator 202 is set by transistor 204 connected to control input 206 of the regulator. When transistor 204 is turned on, the output of regulator 202 is essentially 0. When transistor 204 is turned off, the output of regulator 202 goes to approximately 3.6V and energizes bell signal synthesizer 194 to produce a bell sound at speaker 196.

Two bell sound modes are provided by appropriately setting jumper block 210. Jumper block 210 has a common terminal 216 connected by way of current limiting resistor 212 to the base 214 of transistor 204. The common terminal 216 can be connected by a jumper to either of terminals 218 or 220. If common terminal 216 is connected to terminal 218 then the bell signal is activated only while motor 80 is running and therefore only while the gate is actually being raised or lowered. If common terminal 216 is jumpered to terminal 220, the bell signal is energized continuously from the time the gate is first activated, during the time a train is passing, and until the gate starts to returns to its up position.

Preferably, timer 150 produces an output signal at output 152 for 5 to 6 seconds after the input signal is removed. When a pulse input signal is applied to one of inputs 142 or 144, there is sufficient time for the gate to be lowered even if a short pulse is applied. If a synchronizing signal from another gate is applied to input 140, and the synchronizing input is present for longer than 5 seconds, the timer will activate the motor and optionally the signal lights and bells only while the synchronizing signal is present. If the synchronizing signal is applied to input 140 for less than 5 seconds, the timer will provide a 5 second output. Because inputs 142 and 144 are pulse inputs, even if a train detected signal is applied for a long period of time, timer 150 will time out after approximately 5 seconds and the gate arm will return to its raised position. This could happen if a train is detected by a remote detector but stops before entering the crossing.

Figure 8:
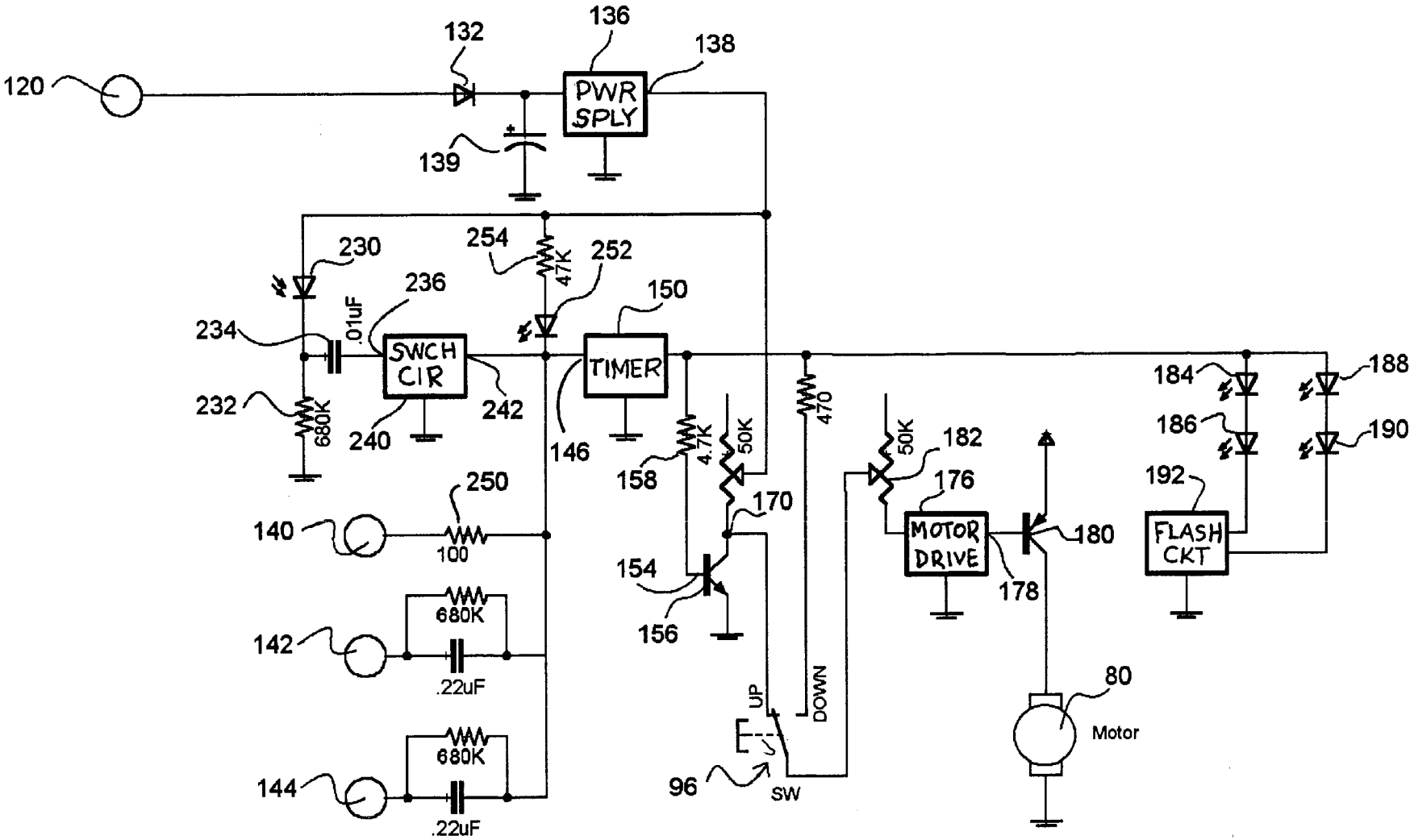
FIG. 8 is a part schematic part block diagram of the other crossing gate of FIG. 1.

Refer now to FIG. 8, the control circuit for crossing gate 20 is shown. Much of the controller shown in FIG. 8 is identical to the controller shown in FIG. 7 and like reference numerals are used to designate corresponding elements. Input terminal 120 is connected by way of diode 132 and filter compacitor 134 to power supply regulator 136. Output 138 is connected to a preferably infrared detector which is responsive to a light signal from infrared emitter 124 as shown in FIG. 7 that passes along path 110 of FIG. 6. The output of detector 230 is coupled by way of a high pass filter that includes a resistor 232 and series coupling capacitor 134 connected to an input 236 of signal conditioning and switching circuit 240. The high pass filter filters out steady ambient light and causes the signal conditioning and switching circuit 240 to respond primarily to the pulsing signal produced by detector 230. Switching circuit 240 has an output 242 connected to input 146 of timer 150. Output 242 is arranged to produce an off signal as long as detector 230 detects a light signal and to turn on when the light signal is interrupted. Timer 150 is responsive to a logic low signal to turn on for about 5 seconds as already described in connection with the similar timer shown in FIG. 7. In this way, when a train interrupts the beam traveling along path 110, the timer is triggered and the gate moves from its raised to its lowered position.

It will be seen that when output 242 of signal conditioner and switching circuit 240 goes low, a ground (logic low) signal is also applied through resistor 250 to terminal 140 which is connected to the like numbered terminal of the controller in FIG. 7. Grounding terminal 140 of FIG. 7 triggers timer 150 of the other crossing gate 20 causing that gate to be lowered. The crossing gates of this invention therefore operate synchronously.

Because an infrared light emitting diode and infrared detector are used in the train detector circuit, the light emitted therefrom is not visible. Preferably, an alignment light emitting diode 252 is provided in series with current limiting resistor 254 connected between output 138 of power supply 136 and the output of signal conditioning and switching circuit 240 in each gate. It will be recalled that output 242 is high when detector 230 detects the light signal. Therefore, alignment LED 252 is normally on, and switches off when the infrared source and infrared detector are aligned.

While the invention has been described in connection with a presently preferred embodiment thereof, those skilled in the art will recognize that certain modifications and changes may be made therein without departing from the true scope of the invention which accordingly is intended to be defined as solely by the appending claims.

What is claimed is:

1. A model railroad crossing gate comprising:

a base;

a crossing gate mounted on the base for movement between a raised position and a lowered position;

a spring coupled to the crossing gate biasing the gate to the raised position;

a string attached to the crossing gate pulling the gate against the spring and lead through the base;

a tensioner in the base for tensioning the string and pulling the gate to the lowered position.

2. The model railroad crossing gate of claim 1 comprising a motor in the base coupled to the tensioner.

3. The model railroad crossing gate of claim 1 comprising a limit sensor coupled to the tensioner for detecting when the gate is fully raised or fully lowered.

4. The model railroad crossing gate of claim 2 comprising a reducing gear train coupled between the motor and the tensioner.

5. The model railroad crossing gate of claim 1 comprising a controller coupled to the tensioner controlling the position of the gate.

6. The model railroad crossing gate of claim 1 in which the tensioner comprises a rotatable cam coupled to the string and tensioning the string as the cam is rotated.

7. The model railroad crossing gate of claim 6 in which the cam comprises a round gear and a post eccentrically mounted on the gear and engaging the string.

8. The model railroad crossing gate of claim 6 comprising a limit sensor coupled to the tensioner for detecting when the gate is fully raised or fully lowered.

9. The model railroad crossing gate of claim 8 in which the limit sensor is coupled to the cam.

10. The model railroad crossing gate of claim 5 in which the controller comprises a first input responsive to an input pulse for causing the gate to move the lowered position for a predetermined period of time, and then return to the raised position.

11. The model railroad crossing gate of claim 5 in which the controller comprises a second input for causing the gate to move to, or remain in the lowered position as long as a signal is present on the second input.

12. The model railroad crossing gate of claim 5 in which the controller comprises an output providing an output signal to another device.

13. The model railroad crossing gate of claim 11 comprising a detector responsive to a light beam coupled to the second input.

14. The model railroad crossing gate of claim 13 in which the detector is an infrared detector.

15. The model railroad crossing gate of claim 5 comprising a light source positioned to be interrupted by the passage of a model train.

16. The model railroad crossing gate of claim 15 in which the light source is an infrared light source.

17. The model railroad crossing gate of claim 16 comprising a visible indicator coupled to the light detector indicating alignment of the source and the detector.

18. The model railroad crossing gate of claim 17 comprising a visible indicator on each of two of a pair of crossing gates, and a synchonization connection between the visible indicators.

19. The crossing gate construction of claim 16 in which the light source is a pulsating light source.

20. The crossing gate construction of claim 19 in which the light detector is responsive to the pulsating light source, and substantially less responsive to a steady light source.

21. A model railroad crossing gate construction for guarding a simulated grade level crossing comprising:

a first crossing gate having a light source;

a second crossing gate having a light detector;

a controller in the second crossing gate maintaining the crossing gate in an up position in response to a signal from the light detector for, and moving the crossing gate to a lowered position in response to the absence of a signal from the light detector;

an electrical connection between the first and second crossing gates synchronizing the operation of the first crossing gate with the second crossing gate.

22. The crossing gate construction of claim 21 in which the light source is a pulsating light source.

23. The crossing gate construction of claim 22 in which the light detector is responsive to the pulsating light source, and substantially less responsive to a steady light source.

24. The crossing gate construction of claim 21 in which the first and second crossing gates are arranged so that the light source normally detected by the light sensor unless a train or other object passes therebetween.

* * * * *

UNITED STATES PATENT AND TRADEMARK OFFICE

CERTIFICATE OF CORRECTION

PATENT NO. : 6,523,788 B2
DATED : February 25, 2003
INVENTOR(S) : Dennis R. Zander It is certified that error appears in the above-identified patent and that said Letters Patent is hereby corrected as shown below:

Title page,
Item [56], References Cited, U.S. PATENT DOCUMENTS, please insert

| | | |
|---|---|---|
| -- | 5,502,367 | Jones |
| | 3,964,704 | Karr |
| | 4,613,103 | Waranowitz |
| | 4,498,650 | Smith, et al. |
| | 5,864,304 | Gerszberg, et al. --. |

Signed and Sealed this

Twenty-sixth Day of August, 2003

JAMES E. ROGAN
*Director of the United States Patent and Trademark Office*